US007654114B2

(12) United States Patent
Xu

(10) Patent No.: US 7,654,114 B2
(45) Date of Patent: Feb. 2, 2010

(54) METHOD FOR KNITTING OUT SEMI-TURN X YARN SEMI-TURN Y YARN STRUCTURAL TEXTURE AND YARN GUIDING MOUTH THEREOF

(76) Inventor: Guobin Xu, Old Town Cereal School, Changtu, Liaoning 112522 (CN)

( * ) Notice: Subject to any disclaimer, the term of this patent is extended or adjusted under 35 U.S.C. 154(b) by 0 days.

(21) Appl. No.: 12/091,844

(22) PCT Filed: Oct. 23, 2006

(86) PCT No.: PCT/CN2006/002817

§ 371 (c)(1),
(2), (4) Date: May 20, 2008

(87) PCT Pub. No.: WO2007/051398

PCT Pub. Date: May 10, 2007

(65) Prior Publication Data

US 2009/0044573 A1 Feb. 19, 2009

(30) Foreign Application Priority Data

Nov. 2, 2005 (CN) ..... 2005 1 0047613

(51) Int. Cl.
*D04B 15/56* (2006.01)

(52) U.S. Cl. ..... 66/126 A; 66/136

(58) Field of Classification Search ..... 66/125 R, 66/126 R, 126 A, 136, 137
See application file for complete search history.

(56) References Cited

U.S. PATENT DOCUMENTS 1,811,849 A * 6/1931 Houseman ..... 66/36

(Continued)

FOREIGN PATENT DOCUMENTS

CN 2258504 Y 7/1997

(Continued)

OTHER PUBLICATIONS

International Search Report for PCT/CN2006/002817 dated Feb. 1, 2007.

(Continued)

*Primary Examiner*—Danny Worrell
(74) *Attorney, Agent, or Firm*—Smith, Gambrell & Russell, LLP

(57) ABSTRACT

Disclosed herein is a method that can adopt the flat weft knitting machine to continuously weave the knitwear whose appearance is a structural texture pattern of X-yarn by a semi-turn (or semi-twist), Y-yarn by the semi-turn and the special-purpose yarn guiding mouth thereof. There is two or three parallel positioned yarn guiding holes provided in a yarn guiding mouth. X-yarn and Y-yarn can be independently fed through two guiding holes being parallel placement; Alternatively, X-yarn, Y-yarn and C-yarn can be independently fed through the three guiding holes being parallel placement; Or, Z-yarn can be fed through outside of the two or three guiding holes being parallel placement. To achieve the fabric whose surface is X-yarn by a semi-turn and Y-yarn by another semi-turn, or appearance in most is X-yarn, and Y-yarn in small part; or most of the appearance is X-yarn and C-yarn by a semi-turn and Y-yarn and C-yarn by another semi-turn; or pattern on the appearance includes several patterns aforesaid, inside is Z-yarn, which are plating knitting, there is no need to change the yarn guiding mouth or the yarn by using the present invention.

13 Claims, 7 Drawing Sheets

U.S. PATENT DOCUMENTS

| | | | | | |
|---|---|---|---|---|---|
| 3,157,035 | A | * | 11/1964 | Boutillette | 66/136 |
| 3,757,537 | A | * | 9/1973 | York | 66/9 R |
| 3,800,564 | A | * | 4/1974 | Carswell | 66/136 |
| 3,826,110 | A | * | 7/1974 | Holder | 66/9 R |
| 4,688,401 | A | * | 8/1987 | Kuhn et al. | 66/141 |
| 4,998,418 | A | * | 3/1991 | Fatigati | 66/14 |
| 6,370,922 | B1 | * | 4/2002 | Brach et al. | 66/136 |
| 6,386,003 | B1 | * | 5/2002 | Wang | 66/136 |
| 7,036,342 | B1 | * | 5/2006 | Hsieh | 66/136 |

FOREIGN PATENT DOCUMENTS

| | | | |
|---|---|---|---|
| CN | 1236834 | A | 12/1999 |
| CN | 2396077 | Y | 9/2000 |
| CN | 1485484 | A | 3/2004 |
| EP | 1176243 | A | 1/2002 |
| GB | 2033931 | A | 5/1980 |
| TW | 394272 | Y | 6/2000 |
| WO | 01/40560 | A | 6/2001 |

OTHER PUBLICATIONS

Written Opinion for PCT/CN2006/002817 dated Feb. 1, 2007.

* cited by examiner

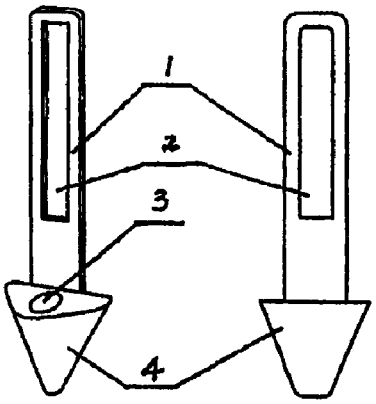
Fig.1-1 Fig.1-2
Fig. 1
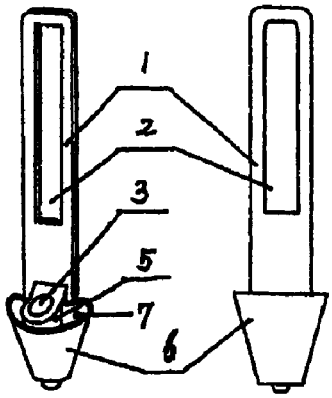
Fig.2-1 Fig.2-2
Fig. 2
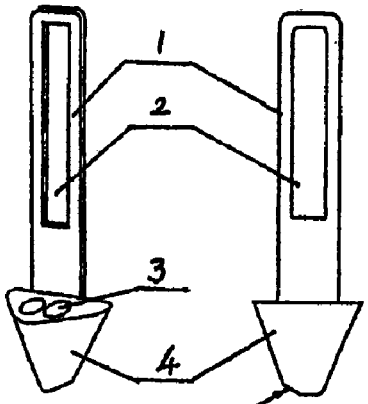
Fig.3-1 Fig.3-2
Fig. 3
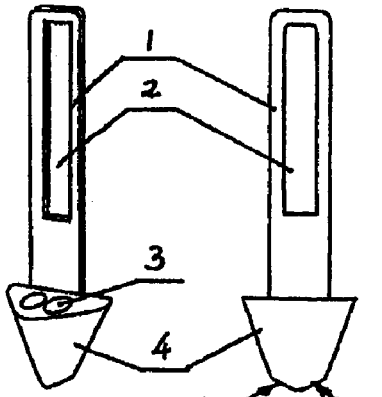
Fig.4-1 Fig.4-2
Fig. 4
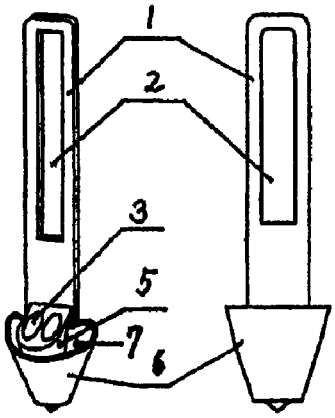
Fig.5-1 Fig.5-2
Fig. 5

METHOD FOR KNITTING OUT SEMI-TURN X YARN SEMI-TURN Y YARN STRUCTURAL TEXTURE AND YARN GUIDING MOUTH THEREOF

FIELD OF THE INVENTION

The invention concerns flat weft-knitting field in the knitting industry, particularly relates to a new method that can adopt the flat weft knitting machine to continuously weave the knitwear whose that appearance can be seen structure texture pattern of X-yarn by a semi-turn (or semi-twist), Y-yarn by the semi-turn and the special-purpose yarn guiding mouth thereof.

BACKGROUND OF THE INVENTION

The flat weft knitting machine in prior art includes flat machine and Kedeng machine, while mechanical flat weft knitting machine has hand-handled or electric driven two types. The yarn guiding mouth on the weft knitting machine has only two forms: One is shown in FIG. 1, of a general yarn guiding mouth, including a fixed bar 1, a movable fixed Bays 2, a guiding hole 3, and a yarn guiding mouth head 4, installed on the flat weft knitting machine via movable fixed bay. Such kind of yarn guiding mouth pattern is now used on 80% of the weft knitting machines (computerized or hand-handled machines). Another type is shown in FIG. 2, a common replenishing yarn guiding mouth, including the fixed bar 1, the movable fixed bays 2, guiding holes 3, a main yarn guiding mouth 5, a replenishing yarn guiding mouth 6, the guiding holes 3 are open on top of the main yarn guiding mouth 5, there is a gap between the main yarn guiding mouth 5 and the replenishing yarn guiding mouth 6 (namely, replenishing yarn hole 7), a base yarn (or main yarn, X-yarn) goes through the main yarn guiding mouth 5, the replenishment yarn (an auxiliary yarn, Z-yarn) goes through the replenishing yarn hole 7. Z-yarn is always higher than X-yarn when functioning. This kind of replenishing yarn guiding mouth is mainly used to weave the replenishing yarn pattern. When the pattern is a single-sided pattern or stripe pattern, X-yarn is always on the front, while the Z yarn is always on the reverse side; When the pattern is Siping code or double-sided, X-yarn is at the surface, Z yarn is at the inside, in another word, base yarn (main yarn) coated the replenishment yarn (the auxiliary yarn) is coated by the main yarn; this can be applied to elastic material clothes, pants or coat collar, sleeves, cuff, hem, edges, the application rate can be of 20%. The above two type of yarn guiding mouth is commonly used in production and the third derivative yarn guiding mouth has not found so far.

Conventional technologies of weaving bands of color have to change yarn manually, while machinery changes the yarn guiding mouth. Particularly, when producing the one yarn, one color replacement pattern, the mechanical devices transform the yarn guiding mouth, so as to achieve a switch to X-yarn, then switch to a Y-yarn, workers rely on the memory to repeat the cycle of transformation of the yarn guiding mouth. The smallest bands are knitted by changing a yarn for each turn with the method, or switch color for each twist. The shortcoming of this approach is: easily remember incorrectly, and it is difficult to needle the collar. It could easily produce sub-quality product. However, cost by using a method of computer-controlled weaving is very high with double working hours to produce the same product which is to be done manually. The cost of working hours, relying on yarn for weaving from the guiding mouth has been doubled, compared with the cost of ordinary yarn woven manually. Production cost has been doubled as well.

Conventional production methods of weaving are as follows.

(1) The guiding mouth employed on a single color of the fabric, that is, as shown in FIG. 1 ordinary yarn guiding mouth;

(2) X, Y colored yarn is woven together, its textured surface changes irregularly, this approach also uses the ordinary yarn guiding mouth (as seen in FIG. 1);

(3) FIG. 2 shows that the pattern woven out through the replenishing yarn guiding mouth by putting X-yarn at the front view, Y-yarn to the reverse side). This method can replenish elastic yarn such as spandex yarn, nylon yarn for knitting gloves, socks, elastic pants, a jacket collar, lower hem edge, and so on.

(4) Other yarn weaving is about X-yarn in a turn and Y-yarn in another turn, in which yarn changing device was applied manually or computer-based automatic yarn guiding mouth was applied. Yarn changing and guiding mouth and adjusting machine needle into circles et al. were applied to other yarn weaving such as Jacquard.

SUMMARY OF THE INVENTION

The purpose of this invention is to provide the method for knitting out semi-turn X-yarn and semi-turn Y-yarn structural texture and the yarn guiding mouth (or thread guide) thereof. This method does not require changing the yarn and the yarn guiding mouth, and it is not necessary to memorize the changing manually, thus its production takes the same working hours as the common replenishing yarn guiding mouth does.

The technological program of the invention is as follows.

The method for knitting out semi-turn X-yarn semi-turn and Y-yarn structural texture is that X-yarn and Y-yarn can be fed through two yarn guiding holes being parallel placement independently; Alternatively, X-yarn, Y-yarn and C-yarn can be independently fed through three guiding holes being parallel placement; Or, Z-yarn can be fed through outside of two or three guiding holes being parallel placement.

The method for knitting out semi-turn X-yarn and semi-turn Y-yarn structural texture is that X-yarn and Y-yarn are separately fed through two guiding holes being parallel placement. The two guiding holes are used as both of a main yarn guiding hole and a replenishing yarn hole;

Under the condition of an exterior edge of one guiding hole, at an exit of guiding hole, is higher than an interior edge of the guiding hole, and height of the exterior edge and the interior edge of another guiding hole, at the exit of guiding hole, are the same, if X-yarn is higher than Y-yarn before forming a ring (or circular), pattern of circled tissue is organized with Y-yarn on the surface or at the front and X-yarn inside or reverse side; if Y-yarn is higher than X-yarn before forming a ring, pattern of circled tissue is organized with X-yarn on the surface or at the front and Y-yarn inside or reverse side; However, X-yarn and Y-yarn have the same height in another way of semi-turn weaving, then, after forming a circle, weaving pattern is organized with X-yarn and Y-yarn at the same time, as an irregular distribution pattern. Ultimately, the entire weaving appearance is that X-yarn or Y-yarn pattern in one semi-turn weaving, X-yarn and Y-yarn coexistence pattern in another semi-turn weaving, wherein the pattern is a replenishment coated yarn weaving pattern;

When the exterior edges of the guiding holes, at the exit of guiding holes, are higher than interior edges of the two guiding holes, If X-yarn is higher than Y-yarn in semi-turn weaving before forming a ring, the pattern of circled tissue is organized Y-yarn on the surface or at the front and X-yarn inside or reverse side; if Y-yarn is higher than X-yarn in semi-turn weaving, the pattern of circled tissue shows that X-yarn forms on the surface or at the front, Y-yarn forms inside or reverse side. Ultimately, the entire external pattern of weaving appears semi-turn X-yarn and semi-turn Y-yarn, which is a replenishing yarn coated weaving pattern.

The method for knitting out semi-turn X-yarn and semi-turn Y-yarn structural texture is that X-yarn and Y-yarn are separately fed through two guiding holes being parallel placement, while Z-yarn is fed through outside of the two parallel positioned guiding holes. The height of Z-yarn is as the same as highest point of X-yarn or Y-yarn, or slightly higher than that of X-yarn and Y-yarn;

When exterior edge of one guiding hole, at exit of guiding hole, is higher than its interior edge, and exterior edge of another guiding hole, at exit of guiding hole, has the same height as its interior edge, pattern appearance of the entire yarn knitting out is that of semi-turn X-yarn, semi-turn X-yarn plus Y-yarn, or semi-turn Y-yarn, semi-turn X-yarn plus Y-yarn on the surface or at the front, while Z-yarn or Z-yarn as main part and X-yarn plus Y-yarn pattern as small part inside or reverse side;

When exterior edges of two guiding holes, at exit of guiding holes, are higher than interior edges of the guiding holes, pattern appearance of the entire yarn weaving out is that of semi-turn X-yarn, semi-turn Y-yarn on the surface or at the front side, while Z-yarn or Z-yarn as main part and X-yarn plus Y-yarn pattern as small part inside or reverse side.

The method for knitting out semi-turn X-yarn and semi-turn Y-yarn structural texture is that: when X-yarn, Y-yarn and C-yarn are fed separately through three guiding holes being parallel placement, exterior edge of the one from two guiding holes on the left and right, being at exit of the two guiding holes, positions higher than its interior edge, exterior edges and interior edges of other two guiding holes being at exit of the two guiding holes are the same height, then: before forming a circle, X-yarn, by the way of semi-turn, positions higher than Y-yarn and C-yarn, wreathed tissue is organized Y-yarn and C-yarn on the surface or front view, and X-yarn inside or reverse side; By the way of another semi-turn weaving, Y-yarn, X-yarn and C-yarn are the same height before forming a circle, wreathed tissue is produced X-yarn, Y-yarn and C-yarn at the same time with irregular distribution pattern on the surface or inside, at the front or reverse side. Ultimately, the entire appearance of weaving is that Y-yarn plus C-yarn produced on the surface or front view by a semi-turn weaving, and X-yarn, Y-yarn, C-yarn coexist by another semi-turn weaving, while X-yarn by a semi-turn weaving and X-yarn plus Y-yarn and C-yarn coexistence by another semi-turn weaving inside or reverse side, which is replenishment coated yarn weaving patterns; When X-yarn, Y-yarn and C-yarn are independently fed through three guiding holes, being parallel placement, exterior edges of the two guiding holes on the left and right, being at exit of the two guiding holes, position higher than their interior edges, exterior edge and interior edge of the guiding hole, in the middle, being at exit of the guiding hole are the same height, then: before forming a circle, X-yarn, by the way of semi-turn, positions higher than Y-yarn and C-yarn, wreathed tissue formation is Y-yarn plus C-yarn on the surface or at the front view, and X-yarn pattern inside or reverse side; By the way of another semi-turn weaving, Y-yarn is higher than X-yarn and C-yarn before forming a circle, wreathed tissue of the circle formation forms X-yarn plus C-yarn on the surface or at the front and Y-yarn inside or reverse side; Eventually, the entire appearance of weaving is that of Y-yarn plus C-yarn by one semi-turn weaving and X-yarn plus C-yarn by another semi-turn weaving on the surface or at the front, while X-yarn by one semi-turn weaving and Y-yarn by another semi-turn weaving inside or reverse side, which is replenishment coated yarn weaving pattern.

The method for knitting out semi-turn X-yarn and semi-turn Y-yarn structural texture is that X-yarn, Y-yarn, C-yarn are separately fed through three guiding holes being parallel placement, while Z-yarn is fed through outside of the three parallel positioned guiding holes, the height of Z-yarn is as the same as highest point of X-yarn, Y-yarn or slightly higher than X-yarn, Y-yarn, C-yarn;

When the exterior edge of one from the two guiding holes on the left and right, being at exit of the two guiding holes, is higher than its interior edge, the exterior edges and interior edges of other two guiding holes being at exit of the two guiding holes are the same height, the entire appearance of weaving is that of Y-yarn plus C-yarn or X-yarn plus C-yarn on the surface or at the front view by one semi-turn weaving and X-yarn plus Y-yarn plus C-yarn by another semi-turn weaving, while Z-yarn or main part of Z-yarn and small part of X-yarn, Y-yarn plus C-yarn patterns inside or reverse side;

When X-yarn, Y-yarn, C-yarn are independently fed through three guiding holes, with parallel placement, exterior edges of the two guiding holes on the left and right, being at exit of the two guiding holes, position higher than their interior edges, edges of both exterior and interior of the guiding hole in the middle being at exit of the guiding hole are of the same height, the entire appearance of weaving is that of X-yarn plus C-yarn by a semi-turn weaving or Y-yarn plus C-yarn by another semi-turn weaving on the surface or at the front view, while Z-yarn or main part of Z-yarn and small part of X-yarn and Y-yarn plus C-yarn patterns inside or reverse side.

A yarn guiding mouth for knitting out semi-turn x-yarn semi-turn y-yarn structural texture, comprising the guiding holes having two or three parallel positioned holes; Wherein longitudinal cross sections of two guiding holes can be structured that exterior edge of the one from the two guiding holes at the exit of guiding hole is higher than its interior edge, edges of both exterior and interior of another guiding hole being at exit of the guiding hole are of the same height; Alternatively, exterior edges of the two guiding holes at the exit of guiding hole are higher than their interior edges; Wherein longitudinal cross sections of three guiding holes, exterior edge of the one from the two guiding holes on the left and right, being at exit of the two guiding holes, positions higher than its interior edge, edges of both exterior and interior of other two guiding holes being at exit of the guiding hole are of the same height; Or, exterior edges of the two guiding holes on the left and right, being at exit of the two guiding holes, position higher than their interior edges, edges of both exterior and interior of the guiding hole in the middle being at exit of the guiding hole are of the same height.

The said guiding holes are set up on a head of yarn guiding mouth of conventional yarn guiding mouth, or the said guiding holes are set up on a main yarn guiding mouth of the conventional replenishing yarn guiding mouth.

When the two guiding holes being parallel placement are applied, the surface of the one guiding hole at the exit of guiding hole forms inclined plane or stepped shape; or the surface of the two guiding holes at the exit of guiding hole form inclined plane or stepped shape.

When the three guiding holes being parallel placement are applied, the surface of the one from the two exit of guiding holes both on the left and right forms inclined plane or stepped shape, and other surfaces of the two exit of guiding holes are plane shape; or the two surfaces of the exit of guiding holes both on the left and right form inclined plane or stepped shape and the surface of the exit of guiding hole in the middle is plane.

The yarn guiding mouth further provide one yarn guiding hole and a replenishing yarn hole, the yarn guiding hole is set up on the main yarn guiding mouth of ordinary yarn guiding mouth wherein the surface of its exit of guiding hole is with inclined plane or stepped shape.

The technical terms, related to the present invention, of "one turn" or one twist stands for a work period which means that a head of a knitting machine works from starting point of right side, to start work, to left, then works from where it was back to the starting point, namely, from the left side to the right side, that is, "one turn"; Of "semi-turn" or "semi-twist" means a period of that the head of the knitting machine starting from the right side to left or from one side to another side, that is, "semi-turn." X-yarn, Y-yarn, C-yarn, Z-yarn represent different yarn, for instance, different raw materials and different materials, different colors, different reflective effects, different shrinkage, different absorbability, different degree of protecting warmness, different thickness of the yarn, etc. "one-turn X-yarn" indicates that the head of the knitting machine works in reciprocating movement formed two parallel X-yarn patterns; "semi-turn X-yarn" indicates that the head of the knitting machine works from the left side to the right side to form X-yarn pattern.

In addition, the "head", "needle", "needle board", "yarn guiding mouth" and the "circle" are common technical terms used in the knitting industry. The main board consists of the needle board, the head, the needle and other machine components. The main board reciprocates through the head. The needle board plays a role of placing the needle into a needle groove. A triangular device of the head functions to force the needle moving up and down in the needle groove to complete the weaving process of being a circle when the head moves from left to right on a rail of the main board.

The head is installed on the needle board moving back and forth along the needle rail, driven by an external force. The triangular device of the head functions to force the needle to move forward and backward in the needle groove to complete process of weaving the circle. Needle, including a needle hook and a latch or tongue, a needle bar and a needle heel, regularly moves in the groove in vertical direction by using latch's function to open and close automatically, for a delivery of various coils in the process to reach weaving purposes. The yarn guiding mouth is an independent part to be installed in a yarn machine board, functioning to guide knitting wool yarn thread correctly feeding into the needle hook for forming a circle needed.

Advantages Of The Invention:

1. To achieve the fabric whose surface is X-yarn by a semi-turn and Y-yarn by another semi-turn, or appearance in most is X-yarn (about two-thirds), and Y-yarn in small part (about one-third); or most of the appearance is X-yarn and C-yarn by a semi-turn and Y-yarn and C-yarn by another semi-turn; or pattern on the appearance includes several patterns aforesaid, inside is Z yarn, the present invention provides the flat weft knitting machines with function of continuously knitting yarn by using semi-turn technique and components without changing the yarn guiding mouth or the yarn.
2. When the yarn guiding mouth (FIG. 3) design by the present invention is applied on flat-weft knitting machines, regular pattern of X-yarn or Y-yarn by a semi-turn and irregular pattern of X-yarn plus Y-yarn by another semi-turn can be woven out, without changing yarn and the yarn guiding mouth, resulting in the same efficiency with ordinary replenishing yarn and weaving technology, since the height of edges of both exterior and interior of one yarn guiding hole at exit of guiding hole are different and another height of edges of yarn guiding hole at exit of guiding hole are the same.
3. The yarn guiding mouth (FIG. 4, FIG. 10*a-c*) design by the present invention applied on plain-weft machines, during an operation on trial, weaving methods to lead X-yarn and Y-yarn through the two yarn guiding holes, which are as the same as an ordinary replenishing yarn guiding mouth. Structural texture of appearance of X-yarn by a semi-turn or Y-yarn by a semi-turn as well can be knitted out, namely, semi-turn X-yarn or semi-turn Y-yarn on the surface and on the reverse side without changing yarn and yarn guiding mouth and relying on the worker's memory to repeat the cycle of transformation of the yarn guiding mouth.

From the exterior impression of view, the "semi-turn" for colored fabric is completely different from "a turn" for color, Color conversion of a semi-turn intuitively is of fine work, and could be applied to different raw materials and different materials, different colors, different reflective effects, different shrinkage, different absorbability and warming of yarn woven together, which is new updated product with new concept, new idea, novel appearance, and properties of having a nice touch by hand and comfortable feel on body; Meanwhile, the yarn guiding mouth in this invention can, in using, be combined with ordinary yarn guiding mouth, replenishing yarn guiding mouth. The present invention can also be combined with a computer knitting machine together to design more styles of clothing and so on.

The yarn guiding mouth can be changed by using machinery to achieve semi-turn weaving. The cost in ways of both mechanical and manual are high at range of several times to 10 times, and a reject rate of products is very high too. The invention can be applied to various patterns that the appearance is not the same; each has own style, such as single side structural texture of 1×1 needle, 2×2 needles, and so on.

4. If the yarn guiding mouth (FIG. 5) design by the present invention is applied on plain-weft machines, X-yarn and Y-yarn are respectively fed through two parallel positioned guiding holes and Z-yarn is fed through outside of two parallel positioned guiding holes or outside of main yarn guiding mouth. This is the third kind of yarn guiding mouth with replenishment functions applied on weft for the plane (Ping-weft machine) does not need to change yarn and guiding mouth for guidance being capable of continuous weaving X-yarn or Y-yarn by one semi-turn on the surface or at the front view, and Z-yarn pattern by other semi-turn inside or reverse side, namely, three strands of yarn: X-yarn, Y-yarn and Z-yarn are feeding.
5. The yarn guiding mouth (FIG. 11*a-b*) design by the present invention can be applied on plain-weft machines. X-yarn, Y-yarn and Z-yarn are respectively fed through three parallel positioned guiding holes for meeting requirement of without changing yarn and guiding mouth. Continuous weaving can be achieved that X-yarn plus C-yarn by one semi-turn at the front view or on the surface (irregular, depending on the yarn thickness) and Y-yarn in a reverse side or inside; or Y-yarn plus C-yarn by other semi-turn (irregular, depending on the yarn thickness) at the front view or on the surface and X-yarn in a reverse side or inside, which has the same efficiency compared with ordinary replenishing yarn, woven technology.
6. When the yarn guiding mouth (FIG. 12) design by the present invention is applied on Ping-weft machines, without changing yarn and guiding mouth, X-yarn, Y-yarn and C-yarn are respectively fed through three parallel positioned guiding holes, and Z-yarn is fed through outside of the three parallel positioned guiding holes. Continuous weaving can be achieved that X-yarn plus C-yarn by one semi-turn (irregular, depending on the yarn thickness) Y-yarn plus C-yarn by another semi-turn on the surface or at the front side, Z-yarn or main portion of Z-yarn (about two thirds) and small portion (about one-third) of semi-turn X-yarn or semi-turn Y-yarn (no rules, depending on the yarn thickness) pattern inside or reverse side; Or Y-yarn plus C-yarn or X yarn plus C-yarn by one semi-turn weaving (irregular, depending on the yarn thickness), or X yarn plus Y-yarn plus C-yarn by another semi-turn weaving (irregular, depending on the yarn thickness) on the surface or at the front side, Z-yarn or main portion of Z-yarn (about two thirds) and small portion (about one-third) of X-yarn, Y-yarn plus (or and) C-yarn (no rules, depending on the yarn thickness) pattern inside or reverse side; This has the same efficiency compared with ordinary replenishing yarn, woven technology.

7. There are different effects by applying the present invention on different patterns or structural texture, such as collar, sleeves edge, cuff, leading edge or collar edge, side of the front of a garment which is the portion around button or button hole, pocket and pocket side, wherein, patterns of both front view and reverse side view of single side products have different feelings when touching can be integrated into the design. Meanwhile, it is necessary to be designed in combination with computers. The design of knitwear in this invention is more than the original form for many times, and the design of the style of the present invention is also more than the original for several times or more.

BRIEF DESCRIPTION OF THE DRAWINGS

FIG. 1 shows a structure of common yarn guiding mouth in prior art; wherein, FIG. 1-1 is three-dimensional diagram, FIG. 1-2 is the front view.

FIG. 2 shows a structure of common yarn guiding mouth with replenishment function in prior art; wherein, FIG. 2-1 is the three-dimensional diagram of, FIG. 2-2 is the front view.

FIG. 3 is a structure of the first kind of yarn guiding mouth with replenishment function in this invention; wherein, FIG. 3-1 is the three-dimensional diagram, FIG. 3-2 is the front view.

FIG. 4 is a structure of the second kind of yarn guiding mouth with replenishment function in this invention; wherein, FIG. 4-1 is the three-dimensional diagram, FIG. 4-2 is the front view.

FIG. 5 is a structure of the third kind of yarn guiding mouth with replenishment function in this invention; wherein, FIG. 5-1 is the three-dimensional diagram; FIG. 5-2 is the front view.

FIG. 10*b* is the bottom view of FIG. 10*a*. FIG. 10*c* is the three-dimensional view of the diagram.

FIG. 11*a-b* is a structure of the fifth kind of yarn guiding mouth with replenishment function created by this invention; wherein, FIG. 11*a* is the cross-section view, FIG. 11*b* is the three-dimensional diagram.

Reference numbers refer to:

1 is the fixed bar, 2 is the movable fixed groove, 3 is the guiding hole, 4 is the head of yarn guiding mouth, 5 is the main yarn guiding mouth, 6 is the replenishing yarn guiding mouth, 7 is the replenishing yarn hole, 8 is the interior edge of guiding hole, 9 is the exterior edge of guiding hole, 10 is X yarn, 11 is Y-yarn, 12 is the machine needle, 13 is the exit of guiding hole, 14 is the needle board, 15 is the stepped shape, 16 is X-yarn guiding hole, 17 is C-yarn guiding hole, 18 is Y-yarn guiding hole, 19 is C-yarn;

a: an inclined plane, b: an inclined plane, c: a movement direction of the head of a knitting machine.

DETAILED DESCRIPTION OF THE INVENTION

The invention, applied to the flat weft knitting machine, can continually knit out yarn in appearance of X-yarn and Y-yarn patterns by semi-turn weaving.

Figure 6:
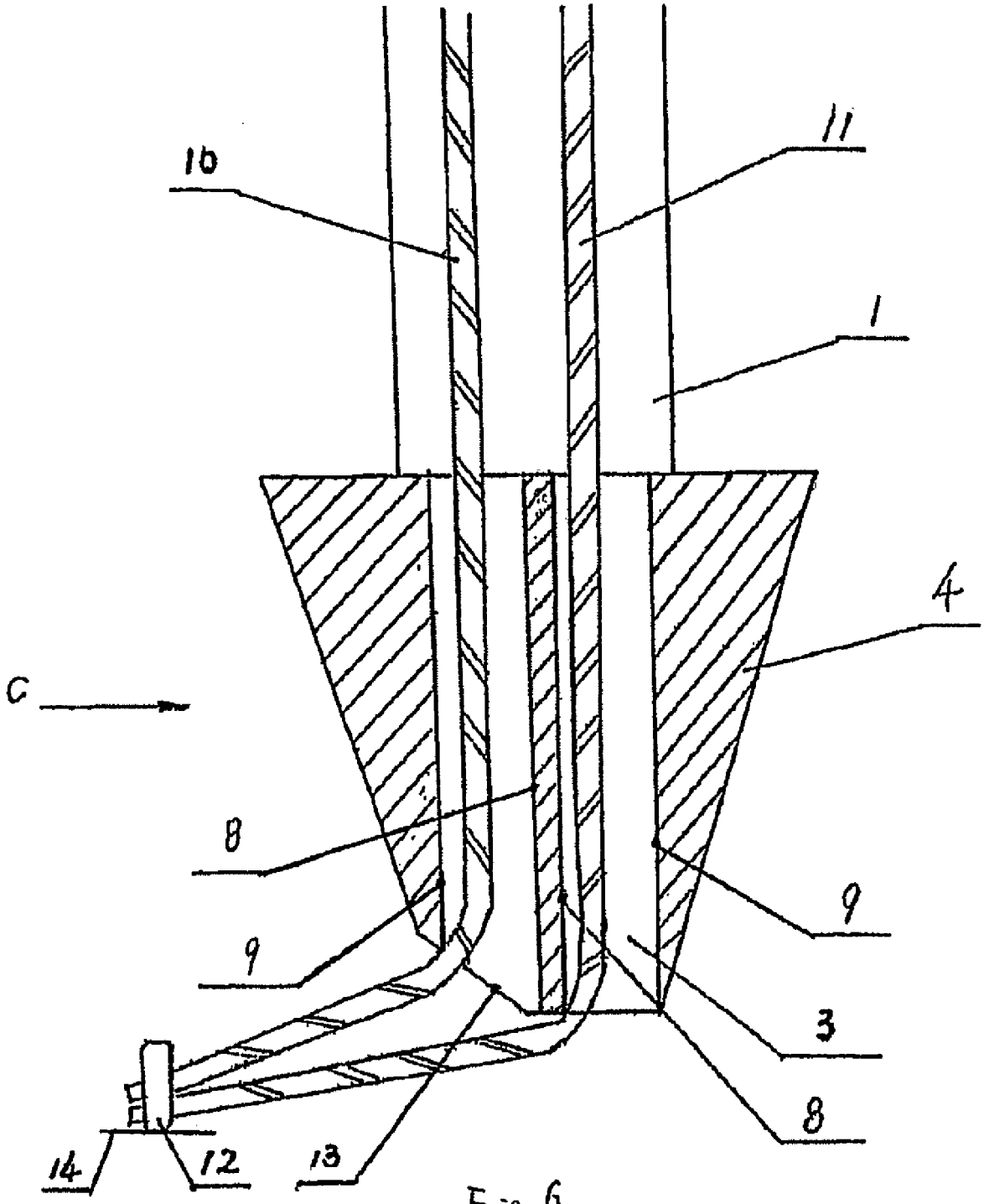
FIG. 6 is a cross-section of the first kind of yarn guiding mouth with replenishment function in this invention.

(I) As shown in FIG. 3 and FIG. 6 below, the first kind of new yarn guiding mouth with replenishment function in this invention includes the fixed bar 1, the movable fixed groove 2, the guiding holes 3, the head of yarn guiding mouth 4. The guiding holes are parallel positioned, wherein, a surface of the exit of guiding hole 13 on the left is inclined plane a. At cross-section of the two guiding holes, the exterior edge of one guiding hole on the left, at the exit of guiding hole, is higher than the interior edge of guiding hole 8, the exterior edge and interior edge of another guiding hole on the right, at the exit of guiding hole, are the same height. Two strands of yarn, X-yarn 10 and Y-yarn 11 are fed through the two parallel positioned guiding holes into the needle 12 placing on the needle plate 14. Two strands of yarn X-yarn and Y-yarn respectively go through the two guiding holes for weaving. The head of the needle works from left to right (c direction). X-yarn is higher than y-yarn in a way of semi-turn. The pattern formed Y-yarn on the front view, X-yarn on the reverse side after forming a circular; the head of needle works from right to left, X-yarn and Y-yarn are at the same height in another way of semi-turn. The pattern of both front view and reverse side coexisted X-yarn and Y-yarn with irregular distribution. Ultimately, the entire weaving appearance is that X-yarn or Y-yarn pattern during one way semi-turn weaving, X-yarn and Y-yarn coexistence pattern during other semi-turn weaving, wherein the pattern is a replenishment coated yarn weaving pattern. In other words, with appearance, one kind of yarn is about two-third, another kind of yarn is about one-third. Methods of weaving and operating on trial are in similarity to the common yarn guiding mouth. But note that:

(1) The distance between a clip (or a gripper) and the yarn guiding mouth of yarn with two strands shall be correctly positioned, the yarn of two strands can not be twisted together.

(2) The skip draft shall be with an appropriate tension. The distance between the yarn guiding mouth and the needle for forming a circle shall be well adjusted, and the two sides need to be basically consistent with each other.

(3) The distance from the yarn guiding mouth to the needle used for forming the circle shall be appropriate. Two sides of both on the left and on the right need to be consistent with each other.

(4) The distance in vertical between the yarn guiding mouth and needle used for forming the circle shall be appropriate level for avoiding yarn coated improper or run phenomenon.

The patterns in appearance of X-yarn on the surface in one way of semi-turn weaving, X-yarn or Y-yarn patterns with irregular pattern by another semi-turn weaving can be continually weaved out when the yarn guiding mouth of the present invention is applied on flat-weft machines. This can be applied to all kinds of knitwear in combination with conventional yarn guiding mouth and methods in prior art.

Figure 7:
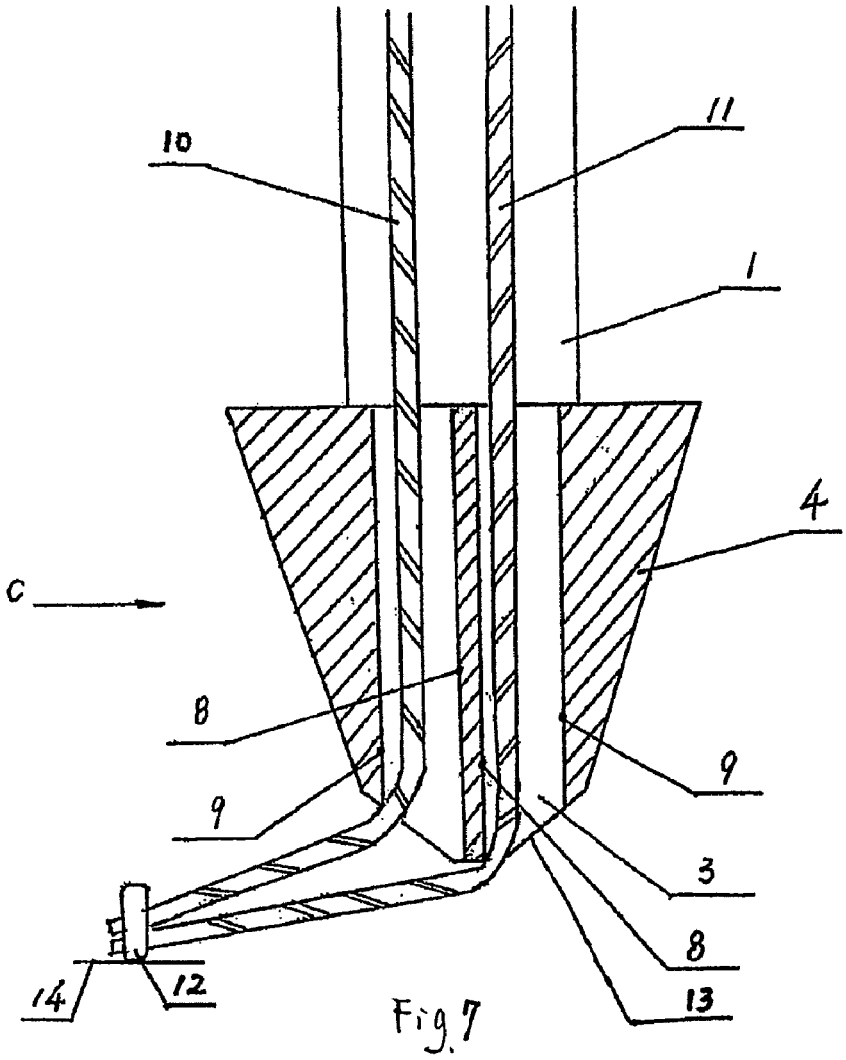
FIG. 7 is a cross-section of the second kind of yarn guiding mouth with replenishment function in this invention.

(II) Referring to FIG. 4 and FIG. 7, the second kind of yarn guiding mouth in the present invention comprise of the fixed bar 1, the movable fixed groove 2, the guiding hole 3 and the head of yarn guiding mouth 4, wherein the guiding hole are two with paralleled placement. The surface of the two exits of guiding holes 13 are as inclined plane b. From a view of the cross-section of the guiding holes in vertical direction, the exterior edges of the two exits of yarn guiding holes are higher than their interior edges. Two strands of yarn, X-yarn 10 and Y-yarn 11 are fed through two parallel positioned guiding holes on the left and on the right lead into the machine needle 12. The needle 12 is positioned on the needle plate 14. X-yarn and Y-yarn go respectively through the two guiding holes for weaving. The whole appearance of the pattern weaved out can be seen as semi-turn X-yarn, semi-turn Y-yarn on both the front and reverse side, namely, X-yarn in one semi-turn, Y-yarn in another semi-turn in appearance of the pattern. The operating on trial or the debug is similar to the first kind of yarn guiding mouth referenced above.

As shown in FIG. 7, the cross-section of working process of the second kind of yarn guiding mouth with replenishment function by working with the head from left to right (c direction), wherein the guiding hole was designed in different diameters according to different type of machine, and height of the interior edge of guiding hole 8 and the exterior edge of guiding hole 9 shall be designed based on models of machine. Common materials of yarn guiding mouth with replenishment function and common yarn guiding mouth can be used in this invention. Reference number 10 indicates X-yarn, 11 indicates Y-yarn, which are fed through parallel positioned two guiding holes, X-yarn 10 and Y-yarn 11 go through holes guiding by the exterior edge of guiding hole 9 on the left and the interior edge of guiding hole 8 on the right side then into the needle 12 for forming a circle, thereby creating two different levels of yarn feeding angles. The pattern of yarn weaved out by the head moving from left to right at work, X-yarn on the reverse side in one semi-turn weaving, Y-yarn at the front view in another semi-turn weaving, namely, semi-turn X-yarn at the front view, semi-turn Y-yarn on the reverse side, in continuously doing so repeatedly, without changing yarn and yarn guiding mouth.

Figure 8:
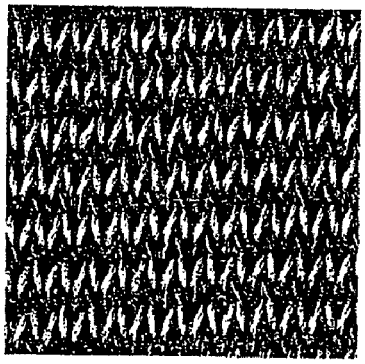
FIG. 8 shows a reverse view of the pattern weaved by this invention.
Figure 9:
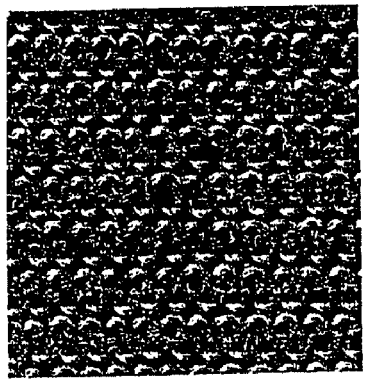
FIG. 9 shows the front view of the pattern weaved by this invention.

As the height of exterior edge and interior edge of the two exits of guiding holes are different, whatever direction the head works (to the left or to the right), it is possible to knit out the pattern, after forming a circular, of X-yarn on the front, Y-yarn on the reverse side in one semi-turn, or Y-yarn on the front, X-yarn on the reverse side in another semi-turn, and in continuously doing so over and over again. Patterns on the surface are as shown in FIG. 8-9. The height of X-yarn and Y-yarn are same since edges of exterior and interior of the two exits of guiding holes have same height; Then the pattern of irregular X-yarn or irregular Y-yarn distribution can be knitted out with the semi-turn effects.

The front view is as shown in FIG. 8, the reverse side is as shown in FIG. 9, thus, the invention can be applied to weaving of knitted materials and clothing materials, such as collars, sleeves edge, clothing side. It may be possible to weave in combination with other methods as well. The method of testing or debugging is similar to the first kind of yarn guiding mouth referenced above.

Moreover, it may be applied to the knitted apparel, with common yarn guiding mouth or other kinds of yarn guiding mouth in the present invention. Computer-based jacquard flat knitting machine and other various forms of weaving method could be used in the invention for patterns of local fashion design, such as upper part of the body and sleeves, collar, sides, or can be used on whole body in a combination with of any weaving way. The raw materials can be blend of one strand, X-yarn, Y-yarn of one strand or double-stranded X-yarn, Y-yarn, satin dyeing, the yarn of the two materials including cotton and polyester fiber, wool and cashmere, cashmere with silk. The raw materials selected has considered in respects of a concept, an idea, shrinkage, the sense of feeling by hand, somatosensory or feel on body, the sense of sag, Sweat-absorbent healthy care and warm keeping. Due to the form of coating in this invention, the double-stranded yarn has same length being combined with each other and forming a circle together, resulting in weaving patterns on the surface being evenly formed with different shrinking rate.

In consideration of color with appearance of the pattern, different colors being complementary can be applied, for example, two colors of yarn such as X-yarn is in light blue color, Y-yarn is in light pink, the pattern weaving out, by the second yarn guiding mouth with replenishment function in the present invention, is in viewing of gray, in a certain distance, in which blue and pink can not be seen. Regarding the complementary colors, new feeling effects can be designed because the two-color units is the smallest knitting distance. Taking reflective, fluorescent as an example, large area of mono-color and monochrome yarn combination can be applied to large part or small part of clothes and the site, edge, collar, sleeves, hem; A band, color strip can be knitted out by using the flat weft knitting machine with a computer design combining various ways and methods.

When the yarn guiding mouth of the invention is applied to flat weft knitting machine, appearance patterns of semi-turn X-yarn and semi-turn Y-yarn can be woven out without changing yarn and yarn guiding mouth. This can be applied to knitting clothing with a variety of styles or with common yarn guiding mouth and methods. Other types clothing or knit goods or other products are also possible.

(III) As shown in FIG. 5, the third kind of yarn guiding mouth with replenishment function comprise of the fixed bar 1, the movable fixed groove 2, the guiding hole 3 and the replenishing yarn guiding mouth 6, wherein the replenishing yarn guiding mouth 6 has main yarn guiding mouth 5 opening two parallel positioned guiding hole. A gap is set between the main yarn guiding mouth 5 and the replenishing yarn guiding mouth 6, as the replenishing yarn hole 7. Similarly, as shown in FIG. 6 and FIG. 7, one the exterior edge of the two exits of yarn guiding holes is higher than its interior edge, in a view of the cross-section of the guiding holes in vertical direction, or the exterior edges of the two exits of yarn guiding holes are higher than their interior edges.

Feeding with yarn of three strands, at working, the height of Z-yarn is always consistent with the highest point of X-yarn and Y-yarn. With this kind of yarn guiding mouth having replenishment function, the pattern knitting out is that:

X-yarn with semi-turn or Y-yarn with semi-turn is on the surface or at the front view, Z-yarn of the most portions is inside or the reverse side (about two-thirds) and a small portion (about one-third) is X-yarn or Y-yarn with semi-turn. Effects are different due to different patterns knitting out. Siping code or the double-sided situation has Patterns on the surface and reverse side; One-sided situation has patterns at front view and on the reverse side. Two kinds of raw materials from main raw materials with two colors can be used as X-yarn, Y-yarn including the elastic nylon, spandex yarn, nylon yarn. Patterns knitted out by the said materials can be applied to elastic clothing or collar, sleeves, the front parts of clothing around button or button hole, hem and so on subsidiary compound and other clothing on the site. The invention can be used in combination with other common yarn guiding mouth, or common yarn guiding month with replenishment function, or the first and the second kinds of yarn guiding mouth with replenishment function provided by this invention thus more styles design will achieve with an unexpected effect. Methods to thread yarn through a hole are: the replenishing yarn hole 7 outside of the main yarn guiding mouth is used for threading Z-yarn, the two guiding holes in the main yarn guiding mouth are for threading X-yarn and Y-yarn. The method of debug refers to the first and second kinds of yarn guiding mouth with replenishment function of the present invention, with exception of threading yarn method through guiding holes, which is that outside of the replenishing yarn hole 7 is for threading Z-yarn having tension being different with X-yarn, Y-yarn, Spandex and nylon yarn are generally employed. The other two guiding holes are used to thread X-yarn and Y-yarn, as two kinds of main yarn, while weaving.

As employing yarn of three strands into yarn, height of Z-yarn can always slightly higher than X-yarn and Y-yarn. The pattern or structural texture knitting out by employing yarn guiding mouth with replenishment function of the invention is that semi-turn X-yarn, semi-turn Y-yarn on the surface or at the front view, inside or reverse side is all Z-yarn.

When the exterior edge of one guiding hole, at the exit of guiding hole, is higher than its interior edge of the guiding hole, and the exterior edge of another guiding hole, at the exit of guiding hole, has the same height as its interior edge, pattern of the whole appearance knitting out is that the surface or the front forms X-yarn in one semi-turn, inside or the reverse side forms X-yarn and Y-yarn in another semi-turn (irregular, depending on the yarn thickness), or Y-yarn in one semi-turn weaving, X-yarn and Y-yarn in another semi-turn weaving (irregular, depending on the yarn thickness), inside or reverse side is Z-yarn or main portion of Z-yarn (about two thirds) and small portion (about one-third) of X-yarn plus Y-yarn (irregular, depending on the yarn thickness).

When the exterior edges of two guiding holes, at the exit of guiding holes, are all higher than their interior edges of, patterns of the whole appearance knitting out are that of semi-turn X-yarn or semi-turn Y-yarn on the surface or at the front, Z-yarn or main portion of Z-yarn and small portion of X-yarn plus Y-yarn inside or the reverse side.

Figure 10A:
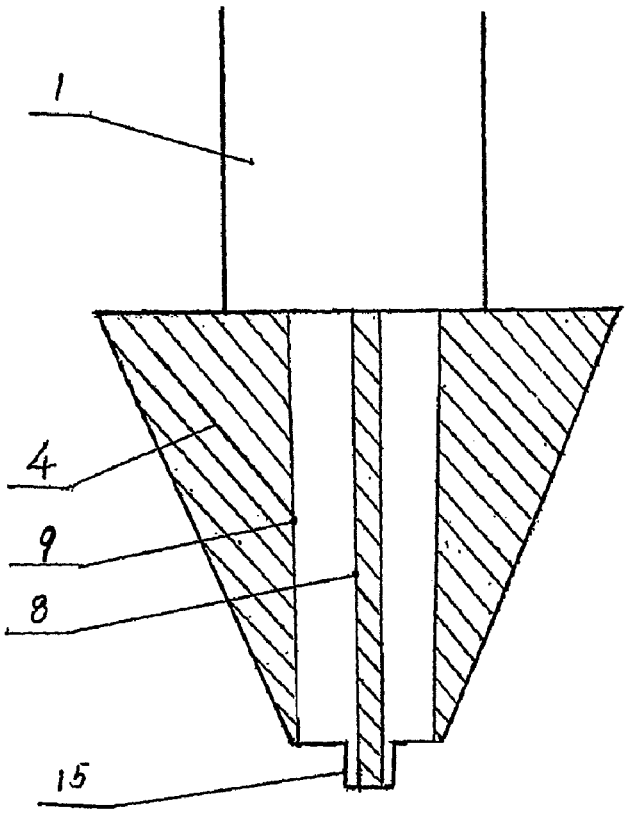
FIG. 10*a-c*, is a structure of the fourth kind of yarn guiding mouth with replenishment function in this invention; wherein, FIG. 10*a* in the front view.
Figure 10B:
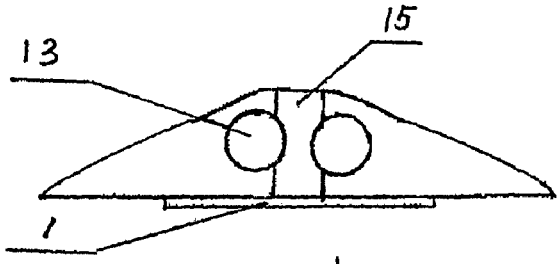
Figure 10C:
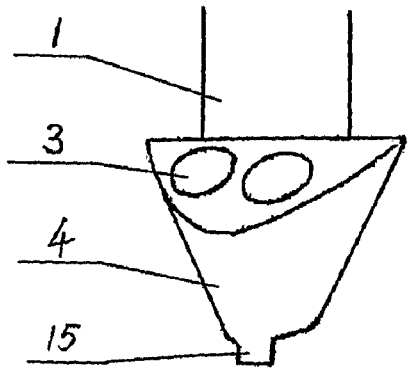

(IV) As shown in FIG. 10*a-c*, compared with the second kind of yarn guiding mouth, the fourth kind of yarn guiding mouth with Replenishment function structure is as follows.

The yarn guiding mouth with replenishment function includes the fixed bar 1, the guiding hole 3, the head of yarn guiding mouth 4, the stepped shape 15, The stepped shape 15 is positioned on the surface of the exit of guiding hole 13, so that the exit of guiding hole 13 forms stepped shape. The exterior edge of guiding holes 9, at the two exit of guiding holes 13, are higher the interior edge of guiding holes 8. Two yarn of two-strands, X-yarn and Y-yarn, are respectively fed through the two parallel positioned guiding holes 3 on the left and right, X-yarn and Y-yarn are guided through the two guiding holes for knitting, patterns knitting out are that X-yarn by one semi-turn weaving or Y-yarn by another semi-turn weaving on the front side and reverse side, namely, in appearance of semi-turn X-yarn or semi-turn Y-yarn. The debug of the invention similarly refers to the first kind of yarn guiding mouth with replenishment function.

As the height of the exterior edge and interior edge of the two guiding holes, at the exit of the guiding hole, are not same, after forming a circle, the pattern of yarn weaved out can be X-yarn at the front view, Y-yarn on the reverse side in a semi-turn, or Y-yarn at the front view, X-yarn on the reverse side in a semi-turn, no matter the direction of the head of needle moves to while working. When the height of the exterior edge and interior edge of the two guiding holes, at the exit of the guiding hole, are same, and X-yarn and Y-yarn have the same height, the pattern of yarn weaved out can be X-yarn or Y-yarn with irregular semi-turn effects.

Figure 11A:
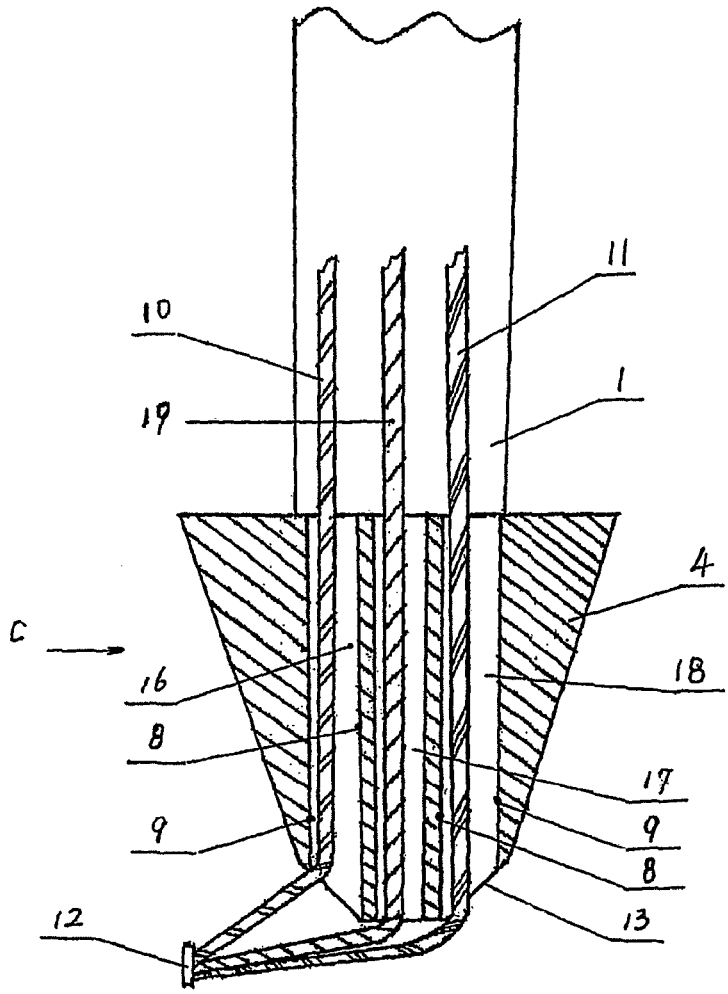
Figure 11B:
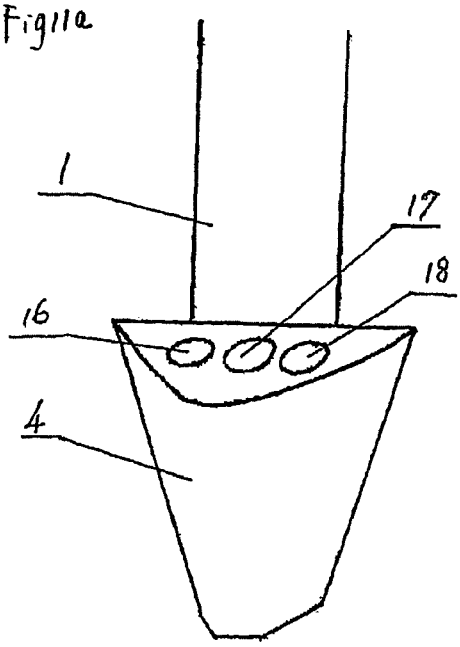

(V) As shown in FIG. 11*a-b*, compared with the second kind of yarn guiding mouth, structure of the fifth kind of yarn guiding mouth with replenishment function is as follows.

The yarn guiding mouth with replenishment function includes the fixed bar 1, the head of yarn guiding mouth 4, the machine needle 12 and the guiding holes having X-yarn guiding hole 16, C-yarn guiding hole 17 and Y-yarn guiding hole 18. At cross-section of the three guiding holes, one exterior edge of the two guiding holes on the left or right sides, at the exit of guiding hole, is higher than its interior edge, other two exterior edges of the two guiding holes, at the exit of guiding hole, are the same height; or two exterior edges of the two guiding holes on the left or right sides, at the exit of guiding hole, are higher than their interior edges, the two edges of the one guiding hole in the middle, at the exit of guiding hole, are the same height.

When X-yarn, Y-yarn and C-yarn are fed separately through three guiding holes being parallel placement, the exterior edge of the one from the two guiding holes on the left and right, being at exit of the two guiding holes, positions higher than its interior edge, the edges of exterior and interior of the other two guiding holes being at exit of the two guiding holes are the same height, then: before forming a ring, X-yarn, by the way of semi-turn, positions higher than Y-yarn and C-yarn, wreathed tissue formation of the front view forms Y-yarn and C-yarn (irregular, depending on the yarn thickness), and pattern, reverse side, is X-yarn; By the way of another semi-turn weaving, Y-yarn, X-yarn and C-yarn are the same height before forming a ring, wreathed tissue formation is that X-yarn, Y-yarn, C-yarn coexistence situation with irregular distribution on the front view and reverse side. Finally, the entire appearance of weaving is that the surface or front view is Y-yarn and C-yarn by a semi-turn weaving (irregular distribution, depending on the yarn thickness), coexistence situation with X-yarn, Y-yarn and C-yarn by another semi-turn weaving (irregular distribution, depending on the yarn thickness); Pattern inside or reverse side is X-yarn by a semi-turn weaving, and Y-yarn plus C-yarn coexist (irregular distribution, depending on the yarn thickness) by another semi-turn, which is replenishment coated yarn weaving patterns.

When X-yarn, Y-yarn and C-yarn are fed separately through three guiding holes being parallel placement, the exterior edges of the two guiding holes on the left and right, being at exit of the two guiding holes, position higher than their interior edges, the exterior edge and interior edge of the guiding hole in the middle, being at exit of the guiding hole are the same height; then: before forming a ring, X-yarn, by the way of semi-turn, positions higher than Y-yarn and C-yarn, wreathed tissue formation of on the front view forms Y-yarn and C-yarn (irregular, depending on the yarn thickness), and pattern, reverse side, forms X-yarn; By the way of another semi-turn weaving, Y-yarn positions higher than X-yarn and C-yarn before forming a ring, wreathed tissue of the front view is X-yarn and C-yarn (irregular distribution, depending on the yarn thickness), and wreathed tissue of reverse side is Y-yarn. Ultimately, the entire appearance of weaving is that the surface or the front view forms Y-yarn and C-yarn by a semi-turn weaving (irregular distribution, depending on the yarn thickness), X-yarn and C-yarn by another semi-turn weaving (irregular distribution, depending on the yarn thickness); Pattern inside or reverse side is X-yarn by a semi-turn weaving, and Y-yarn by another semi-turn weaving, which is replenishment coated yarn weaving patterns.

FIG. 11 a shows cross-section of the head working from left to right (c direction), wherein the guiding hole was designed according to different type of the machine, and height of the interior edge of guiding hole 8 and the exterior edge of guiding hole 9 shall be designed based on models of machine. Common materials of yarn guiding mouth with replenishment function and common yarn guiding mouth can be used in this invention. Reference number 10 indicates X-yarn, 11 indicates Y-yarn, 19 indicates C-yarn, which are fed through parallel positioned three guiding holes (X-yarn guiding hole 16, Y-yarn guiding hole 18, C-yarn guiding hole 17), X-yarn 10 and Y-yarn 11 go through holes guided by the exterior edge of guiding hole 9 on the left and the interior edge of guiding hole 8 on the right side then into the needle 12 forming a circle, thereby creating two different levels of yarn feeding angles. The patterns of yarn weaved out by the head moving from left to right at work, are semi-turn X-yarn on the reverse side, semi-turn Y-yarn at the front view; The patterns of yarn weaved out by the head moving from right to left at work, are X-yarn plus C-yarn in semi-turn at the front view, Y-yarn on the reverse side in semi-turn; in continuously doing so repeatedly, without changing yarn and yarn guiding mouth.

As the height of exterior edges and interior edges of the two exits of guiding holes are different, whatever direction the head works, it is possible to knit out the pattern, after forming a circular, of X-yarn and C-yarn on the front, Y-yarn on the reverse side in one semi-turn, or Y-yarn and C-yarn on the front, X-yarn on the reverse side in other semi-turn.

This kind of yarn guiding mouth can also be used to guide the yarn through one guiding hole or two guiding holes in which, according to the following four conditions to thread yarn for wearing: (1) C-yarn, (2) X-yarn and Y-yarn; (3) C-yarn and X-yarn or C-yarn and Y-yarn; (4) X-yarn, Y-yarn and C-yarn.

Figure 12:
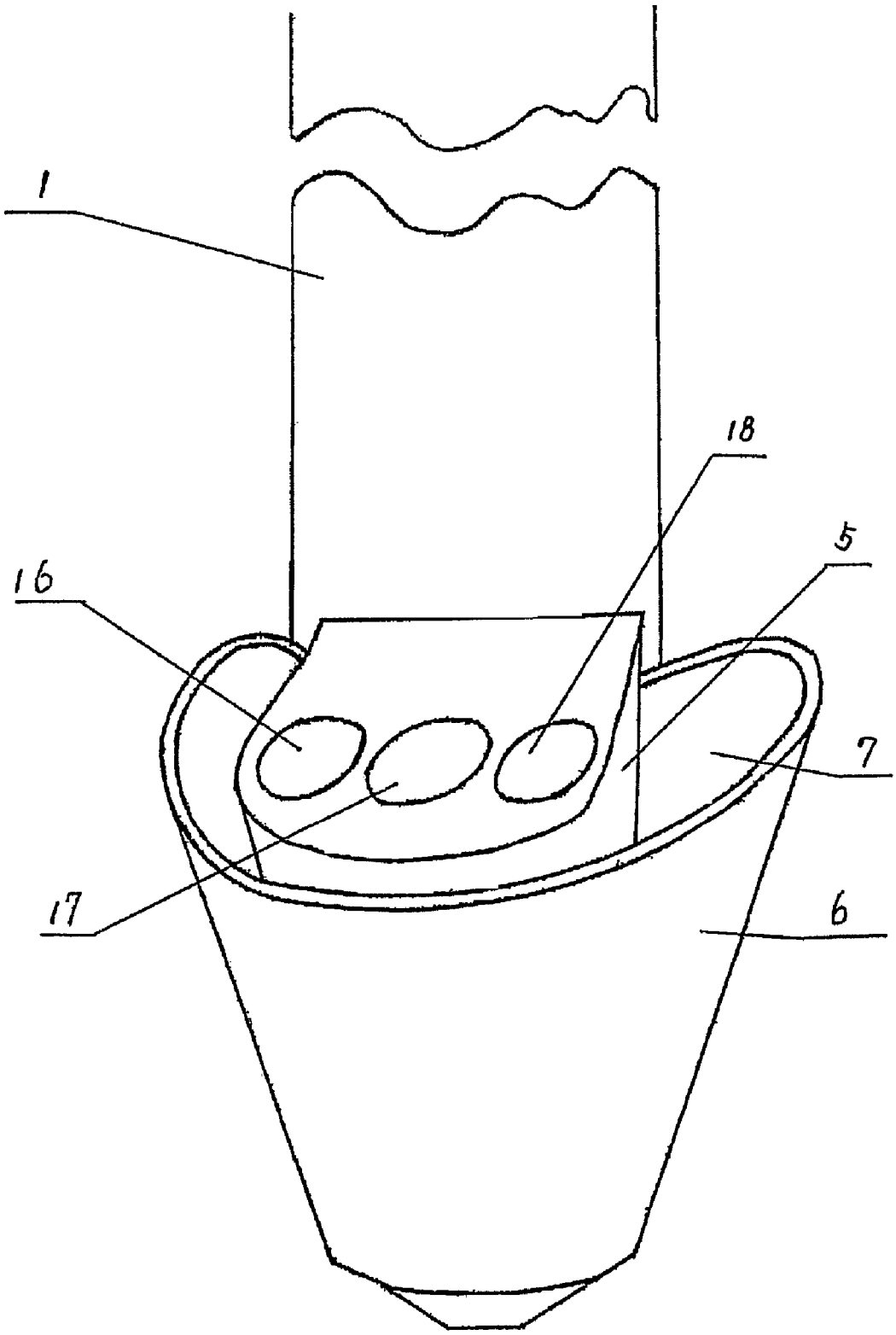
FIG. 12 is a structure of the sixth kind of yarn guiding mouth with replenishment function created by this invention.

(VI) As shown in FIG. 12, compared with the third kind of yarn guiding mouth, the sixth kind of yarn guiding mouth with replenishment function structure is as follows.

The yarn guiding mouth with replenishment function includes the fixed bar 1, the replenishing yarn guiding mouth 6, X-yarn guiding hole 16, C-yarn guiding hole 17 and Y-yarn guiding hole 18. The replenishing yarn guiding mouth 6 has the main yarn guiding mouth 5 having three parallel positioned guiding holes (X-yarn guiding hole 16, C-yarn guiding hole 17 and Y-yarn guiding hole 18). There is a gap between the main yarn guiding mouth 5 and the replenishing yarn guiding mouth 6 (namely a replenishing yarn hole 7)

X-yarn, Y-yarn, C-yarn are separately fed through three guiding holes being parallel placement, Z-yarn is fed through the lateral of the three guiding holes, height of Z-yarn shows no difference with highest point line of X-yarn, Y-yarn; This kind of yarn guiding mouth with replenishment function employs X-yarn guiding hole 16, C-yarn guiding hole 17 and Y-yarn guiding hole 18 and the replenishing yarn hole 7 for feeding yarn.

When the exterior edge of the one from the two guiding holes on the left and right, being at exit of the two guiding holes, positions higher than its interior edge, the exterior edge and interior edge of the other two guiding holes being at exit of the two guiding holes are the same height, for example, X-yarn, by the way of semi-turn, positions higher than Y-yarn and C-yarn; By the way of another semi-turn weaving, Y-yarn, X-yarn and C-yarn are the same height. Finally, the entire appearance of weaving is that the surface or front view is Y-yarn, by a semi-turn weaving, and C-yarn (irregular distribution, depending on the yarn thickness), X-yarn, by another semi-turn weaving, Y-yarn and C-yarn coexist (irregular distribution, depending on the yarn thickness); Pattern, inside or reverse side, of majority (about two-thirds) is Z-yarn, and small portion (about one-third) is X-yarn plus Y-yarn and C-yarn coexist (irregular distribution, depending on the yarn thickness) pattern.

When X-yarn, Y-yarn and C-yarn are fed separately from three guiding holes being parallel placement, the exterior edges of the two guiding holes on the left and right, being at exit of the two guiding holes, position higher than their interior edges, the exterior edge and interior edge of the guiding hole, in the middle, being at exit of the guiding hole are the same height, namely, X-yarn, by the way of semi-turn, positions higher than Y-yarn and C-yarn; By the way of another semi-turn weaving, Y-yarn positions higher than X-yarn and C-yarn. Ultimately, the entire appearance of weaving is that the surface or front view forms X-yarn and C-yarn by a semi-turn weaving (irregular distribution, depending on the yarn thickness), Y-yarn and C-yarn by another semi-turn weaving (irregular distribution, depending on the yarn thickness); Pattern, inside or reverse side, of majority (about two-thirds) is Z-yarn, and small portion (about one-third) X-yarn plus Y-yarn and C-yarn (irregular distribution, depending on the yarn thickness) patterns.

Among them, on the surface and inside is of Siping code or double patterns; Front view and reverse side is the single or rib pattern or structural texture.

Materials can be respectively employed with three kinds yarn materials including spandex yarn, nylon yarn, elastic yarn, or three colors for X-yarn, Y-yarn and C-yarn patterns can be used to knit elastic clothing or subsidiary compound such as collar, sleeves, the front portion of clothing such as portions on the button or and button hole, lower hem and other clothing on the site. The invention can be used in combination with other general yarn guiding mouth, general yarn guiding mouth with replenishment function, or the first to third kinds of yarn guiding mouth with replenishment function provided by the present invention, so that more styles design can be done, and unexpected effective materials can be weaved out. Methods to thread yarn through a hole are: the replenishing yarn hole 7 outside of the main yarn guiding mouth is for Z-yarn, the three guiding holes inside or on the main yarn guiding mouth are for X-yarn, Y-yarn and C-yarn. The method of debug refers to the first and second and the third yarn guiding mouth with replenishment function of the invention with exception of threading yarn through guiding holes, which is that outside of the replenishing yarn hole 7 is for threading Z-yarn having tension being different with X-yarn, Y-yarn and C-yarn. Spandex and nylon yarn are generally employed. The other three guiding holes are used to thread X-yarn, Y-yarn and C-yarn three main yarn while weaving.

This kind of yarn guiding mouth can also be used to guide the yarn through one guiding hole or two guiding holes or three guiding holes with replenishment function, in which, according to the following twelve conditions to thread yarn for wearing: (1) Z-yarn and X-yarn, (2) Z-yarn and Y-yarn; (3) Z-yarn, X-yarn and Y-yarn; (4) Z-yarn, C-yarn and Y-yarn; (5) Z-yarn, C-yarn and X-yarn; (6) Z-yarn and C-yarn; (7) C-yarn; (8) X-yarn and C-yarn; (9) Y-yarn and C-yarn; (10) X-yarn and Y-yarn; (11) Z-yarn, X-yarn, Y-yarn and C-yarn; (12) X-yarn, Y-yarn and C-yarn.

Figure 13:
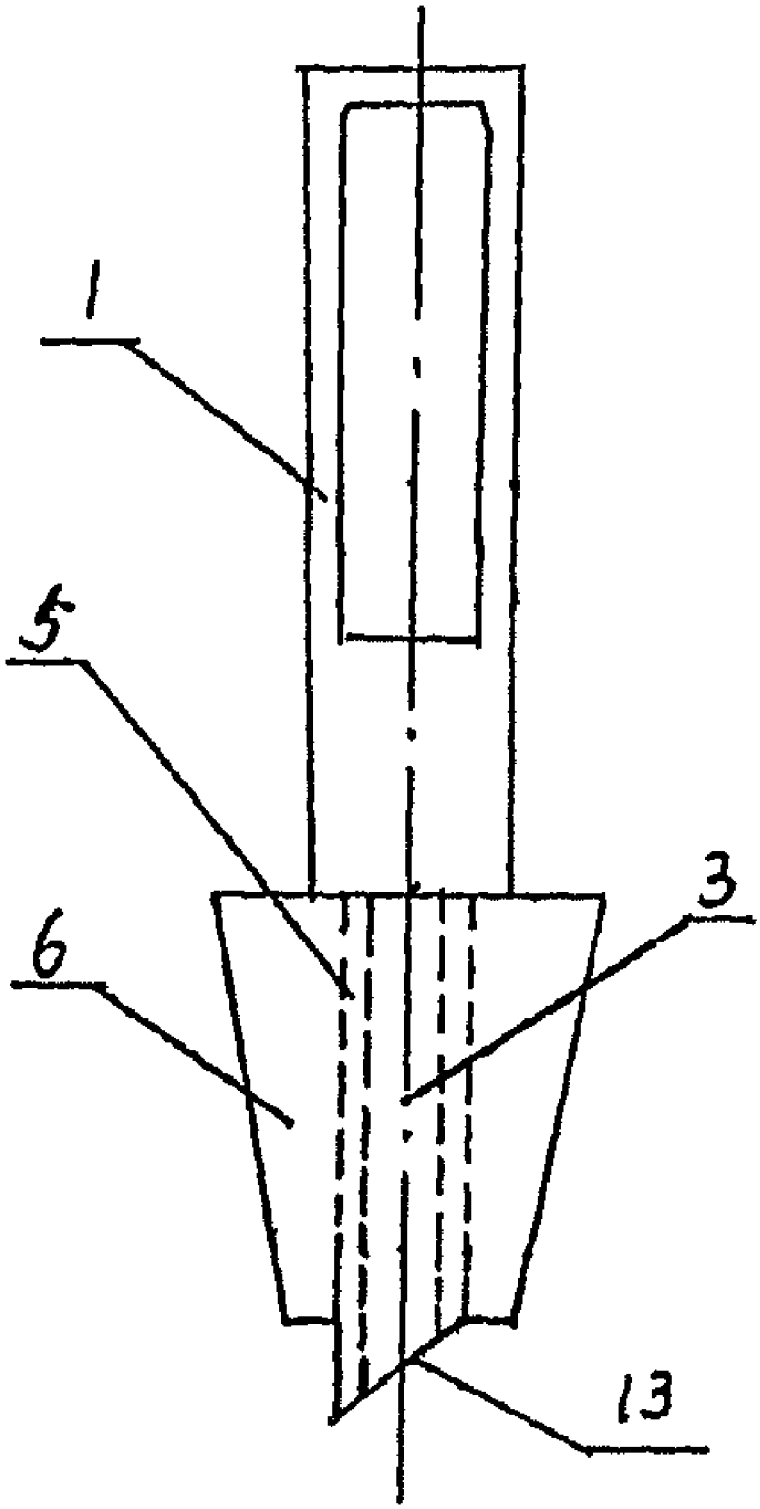
FIG. 13 is a structure of the seventh kind of yarn guiding mouth with replenishment function created by this invention.

As shown in FIG. 13, compared with common yarn guiding mouth, the seventh kind of yarn guiding mouth with replenishment function structure is as follows.

The guiding hole 3 is set on the main yarn guiding mouth 5. A surface of the exit of guiding hole 13 is changed into inclined plane (or stepped shape), namely, one side exit from left and right two sides of yarn guiding holes (the height of it is the same as the replenishing yarn guiding mouth 6 installed on the fixed bar 1) is higher than the one at another side. The entire appearance of weaving created is that the surface or front view forms X-yarn by a semi-turn weaving, and X-yarn and Z-yarn by another semi-turn weaving; Pattern inside or reverse side forms Z-yarn by a semi-turn weaving, and X-yarn plus Z-yarn patterns by another semi-turn weaving.

I claim:

1. A method for knitting out a yarn having a semi-turn X-yarn semi-turn Y-yarn structural texture which comprises providing a first yarn guiding hole which is parallel to a second yarn guiding hole, either (a) placing an exterior edge at the exit of the first yarn guiding hole higher than an interior edge of the first yarn guiding hole, and making the height of the exterior edge and the interior edge at the exit of the second yarn guiding hole the same, or (b) placing the exterior edges at the exits of the first and second yarn guiding holes higher than their interior edges, independently feeding an X-yarn through a first yarn guiding hole, and independently feeding a Y-yarn through a second yarn guiding hole.

2. The method of claim 1, which further comprises providing a third yarn guiding hole which is parallel to the first and second yarn guiding holes and placing the exterior edges and interior edges at the exit of the third yarn guiding hole at the same height, and independently feeding a C-yarn through the third yarn guiding hole.

3. The method of claim 1, which further comprises feeding a Z-yarn through the outside of the first and second yarn guiding holes.

4. The method of claim 1, which further comprises using the two yarn guiding holes as both of a main yarn guiding hole and a replenishing yarn hole; and either placing one of the yarns higher than the other and weaving a ring of knitted yarn comprising the yarn that was placed higher on the outside surface of the ring and the other yarn on the inside surface of the ring, or placing the X-yarn and the Y-yarn at the same height and weaving a knitted yarn having the X-yarn and the Y-yarn in an irregular distribution pattern, to give a replenishment coated yarn weaving pattern.

5. The method of claim 1, which further comprises using the two yarn guiding holes as both of a main yarn guiding hole and a replenishing yarn hole, and placing one of the yarns higher than the other and weaving a ring of knitted yarn comprising the yarn that was placed higher on the inside surface of the ring and the other yarn on the outside surface of the ring, to give a replenishing yarn coated weaving pattern.

6. The method of claim 3, which further comprises placing the Z-yarn at a height that is the same as or higher than the height of the X-yarn, the Y-yarn, or both, and either weaving a ring of yarn to give a weaving pattern having semi-turn X-yarn semi-turn X-yarn plus Y-yarn or semi-turn Y-yarn semi-turn X-yarn plus Y-yarn on the front surface of the ring and Z-yarn or Z-yarn as main part and X-yarn plus Y-yarn pattern as small part on the inside surface or the inside of the ring where the exterior edge at the exit of the first yarn guiding hole is higher than its interior edge, and the exterior edge at the exit of the second yarn guiding hole is at the same height as its interior edge, or weaving a ring of yarn to give a weaving pattern having semi-turn X-yarn semi-turn Y-yarn on the surface on the front surface of the ring and Z-yarn or Z-yarn as main part and X-yarn plus Y-yarn pattern as small part on the inside surface or the inside of the ring where the exterior edges at the exits of the two yarn guiding holes are higher than the interior edges.

7. The method of claim 2, which further comprises placing either the X-yarn or the Y-yarn, by the way of a semi-turn, higher than the other yarn and the C-yarn and weaving to give a replenishment coated yarn weaving pattern, where the exterior edges at the exits of the two yarn guiding holes higher than the interior edges and the interior edges at the same height.

8. The method of claim 2, which further comprises feeding a Z-yarn through the outside of the three yarn guiding holes, placing the Z-yarn at a height that is the same as or higher than the height of the X-yarn, the Y-yarn, or both and weaving the yarn, wherein and weaving the yarn in a ring to give a weaving pattern having the Z-yarn or main part of the Z-yarn and small part of the X-yarn and the Y-yarn plus the C-yarn on the inside or the inside surface.

9. A yarn guiding mouth comprising yarn guiding holes having two or three parallel positioned holes; wherein the longitudinal cross sections of two yarn guiding holes are structured such that an exterior edge at the exit of one of the guiding holes is higher than its interior edge, the interior edge and the exterior edge at the exit of the other yarn guiding hole are of the same height, or the exterior edges at the exits of the two yarn guiding holes are higher than their interior edges; wherein the longitudinal cross sections of the three yarn guiding holes are structured such that the exterior edges at the exits of the two yarn guiding holes are higher than their interior edges, (a) the exterior edges at the exits of one of the two yarn guiding holes on the left and right is higher than its interior edge, and the interior and exterior edges at the exits of the other two yarn guiding holes are at the same height; or (b) the exterior edges at the exits of the two yarn guiding holes on the left and the right are higher than their interior edges and the interior edge and exterior edge at the exit of the third yarn guiding hole are the same height.

10. The yarn guiding mouth of claim 9, wherein the yarn guiding holes are set up on a head of yarn guiding mouth of a conventional yarn guiding mouth, or the said guiding holes are set up on a main yarn guiding mouth of the conventional replenishing yarn guiding mouth.

11. The yarn guiding mouth of claim 9, wherein the surface at the exit of one of the yarn guiding holes forms an inclined plane or a stepped shape; or the surfaces at exits of the two yarn guiding holes form an inclined plane or a stepped shape.

12. The yarn guiding mouth of claim 9, wherein the surface at the exit of the third yarn guiding hole is an inclined plane or a stepped shape independent from the first and second yarn guiding holes.

13. The yarn guiding mouth of claim 9, wherein the yarn guiding mouth is a yarn guiding hole and a replenishing yarn hole, and the yarn guiding hole is set up on a main yarn guiding mouth of ordinary yarn guiding mouth and the surface of the yarn guiding hole at its exit is an inclined plane or a stepped shape.

* * * * *